US007504596B2

(12) United States Patent
Chou

(10) Patent No.: US 7,504,596 B2
(45) Date of Patent: Mar. 17, 2009

(54) KEYBOARD

(75) Inventor: Chin-Wen Chou, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/812,340

(22) Filed: Jun. 18, 2007

(65) Prior Publication Data

US 2008/0308397 A1 Dec. 18, 2008

(51) Int. Cl.
*H01H 13/70* (2006.01)

(52) U.S. Cl. ..... 200/5 A

(58) Field of Classification Search ..... 200/5 A, 200/5 R, 341, 344, 345; 400/472, 490–496; 341/22; 345/168, 169
See application file for complete search history.

(56) References Cited

U.S. PATENT DOCUMENTS 4,092,527 A * 5/1978 Luecke ..... 708/140
4,851,618 A * 7/1989 Amino et al. ..... 200/5 A
5,510,953 A * 4/1996 Merkel ..... 361/680
5,612,692 A * 3/1997 Dugas et al. ..... 341/22
5,969,644 A * 10/1999 Koutaka ..... 341/22
6,212,066 B1 * 4/2001 Fetterman ..... 361/680
6,284,988 B1 * 9/2001 Watanabe et al. ..... 200/5 A
6,288,353 B1 * 9/2001 Chiang ..... 200/512
6,437,972 B1 * 8/2002 Sellers ..... 361/680
6,545,232 B1 * 4/2003 Huo-Lu ..... 200/5 A
6,805,505 B2 * 10/2004 Horiuchi et al. ..... 400/472

FOREIGN PATENT DOCUMENTS

TW 471689 9/1999
TW 582597 1/2003
TW I220214 B 8/2004

* cited by examiner

*Primary Examiner*—Michael A Friedhofer
(74) *Attorney, Agent, or Firm*—Muncy, Geissler, Olds & Lowe, PLLC

(57) ABSTRACT

A keyboard includes a key module and a base. The key module includes at least a second anchor portion. The base has a first anchor portion corresponding to the second anchor portion that is engageable with each other to couple the key module with the base. The base further has a signal transmission module to form electric connection with the key module. The keyboard thus formed is thinner. Assembly is simpler and production cost is lower.

12 Claims, 5 Drawing Sheets

KEYBOARD

BACKGROUND OF THE INVENTION

1. Field of the Invention

The present invention relates to a keyboard and particularly to an improved keyboard with a reduced thickness.

2. Brief Discussion of the Related Art

The conventional keyboards now used on computers for data entry have a key module consisting of keys that are movable vertically or through bridge mechanisms. Reference of the vertical moving structure can be found in R.O.C. patent publication No. 582597, entitled "Improved keyboard structure" which has a key module consisting of a first lid, a second lid, an elastic touch member and a conductive element stacking together. The vertical moving keyboard has a shortcoming, namely it has a significant thickness, thus is not suitable for slim and delicate products such as notebook computers. The thin keyboards mostly adopt the bridge mechanism. The key adopted the bridge mechanism has two movable cross brackets that can be moved vertically under compression for an upward displacement and a downward displacement. Compared with the vertical moving key, the thickness of the bridge key is smaller. Reference can be found in R.O.C. patent No. 1220214, entitled "Keyboard having keys movable in stages" which has FIGS. 1, 2 and 3 showing the basic structure of a key module. It includes a plurality of keycaps, a plurality of support structures (bridge elements), a base board, a circuit film (circuit board) and an elastic film consisting of a plurality of elastic elements stacking together. The base board includes a conductive plate (coupling with a bridge board of the bridge elements) and a base board made of metal. The circuit film is sandwiched between the conductive plate and the metal base board. As the moving displacement of the bridge mechanism is smaller than the vertical moving type, the total thickness of the keyboard is smaller. While the conventional bridge mechanism can reduce the thickness of the keyboard, the thickness of the bridge board takes a significant portion of the thickness of the key module. To remedy this problem, another metal base board was developed that has a plurality of pivotal troughs formed by stamping to hold the bridges and replace the bridge board. R.O.C. patent publication No. 471689, entitled "Improved keyboard key positioning structure" discloses a technique that does not have the bridge board. It has a metal base board stamped to form a plurality of pivotal troughs, and with a circuit film bonding to the metal base board to make the key module slimmer and lighter. But with the metal base board replacing the bridge board also has disadvantages. The conventional bridge board usually is made from plastic injection, thus the cost and technique are lower, and production yield is higher. The metal base board formed by stamping costs higher cost and requires a more sophisticated technique. Production yield is lower. Moreover, in the event that an excessive error happens to any of the pivotal troughs, the entire base board becomes useless and has to be discarded. Hence the average cost of each key module is higher. Moreover, the plastic bridge is easily worn out caused by friction against the metal base board. The life span of the bridge element is lower. At present the keyboard equipped with the bridge mechanism still adopts the bridge board or the base board to replace the bridge board. Either type has its benefits and drawbacks. Nowadays slim and light have become norm of the key module. The main factor that affects the thickness of the keyboard is the thickness of the upper lid and the lower lid. The total thickness of the upper lid and lower lid almost equals to the thickness of the keyboard.

Hence the upper lid and lower lid that form the border of the keyboard become a hindrance to further reduce the keyboard thickness.

SUMMARY OF THE INVENTION

In view of the problem of conventional keyboards that have difficulty to further reduce the thickness the primary object of the present invention is to provide a keyboard to improve the thickness of the surrounding lids.

The keyboard according to the invention includes a base and a key module that are coupled together. The base has at least one loading surface. The key module includes at least a circuit board and an elastic click member located thereon, a holding board consisting of a plurality of fastening portions, a plurality of keycaps each having a coupling portion and a plurality of bridge mechanisms coupling the fastening portions and the coupling portions. The base and the key module have respectively a first anchor portion and a second anchor portion mating each other to form a confining relationship. By coupling the second anchor portion of the key module with the first anchor portion of the base, a simple keyboard is formed at a reduced thickness. Fabrication and assembly are simpler, and the cost is lower.

Further scope of the applicability of the present invention will become apparent from the detailed description given hereinafter. However, it should be understood that the detailed description and specific examples, while indicating preferred embodiments of the invention, are given by way of illustration only, since various chances and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
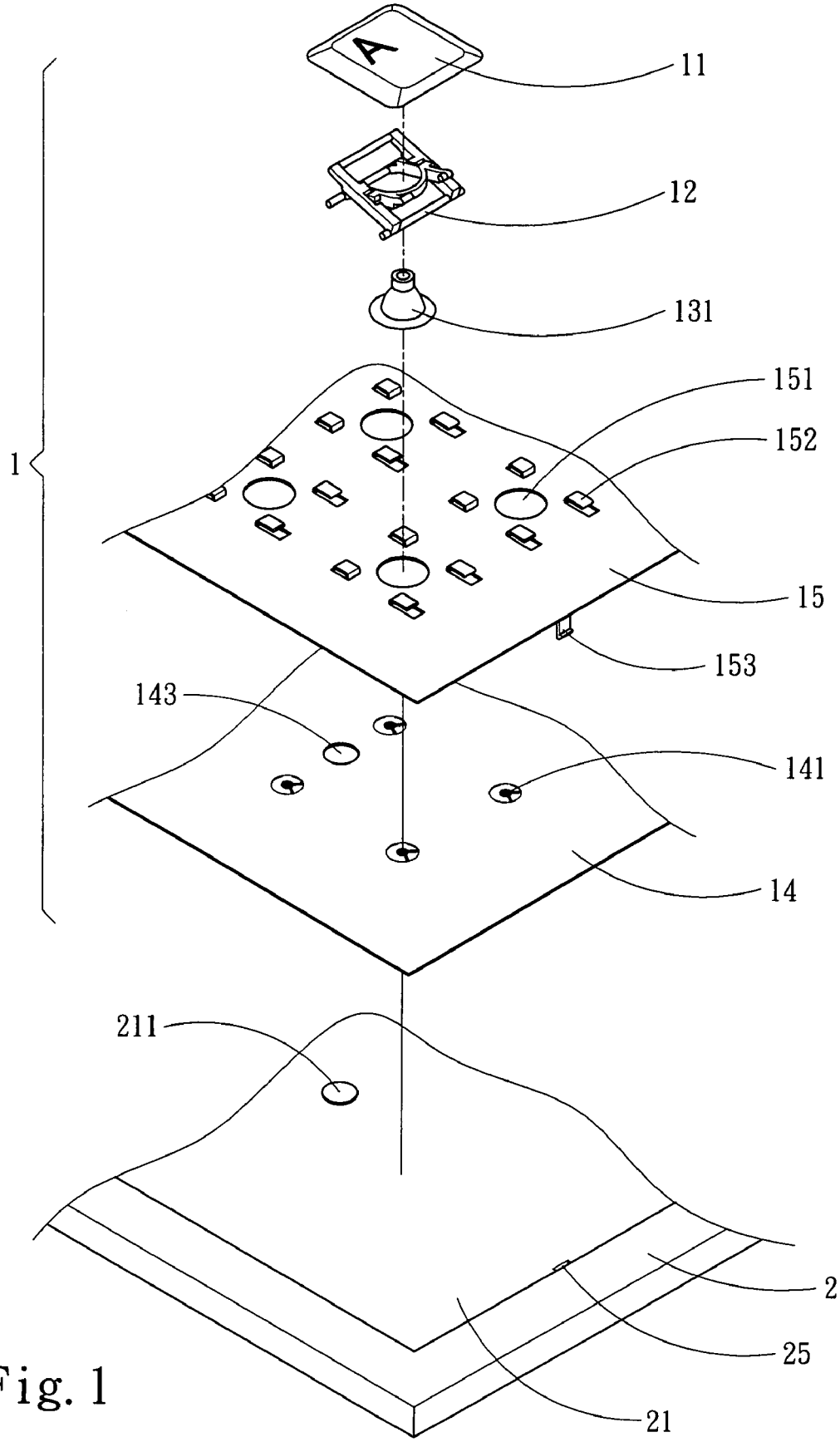
FIG. 1 is an exploded view of the invention.
Figure 2:
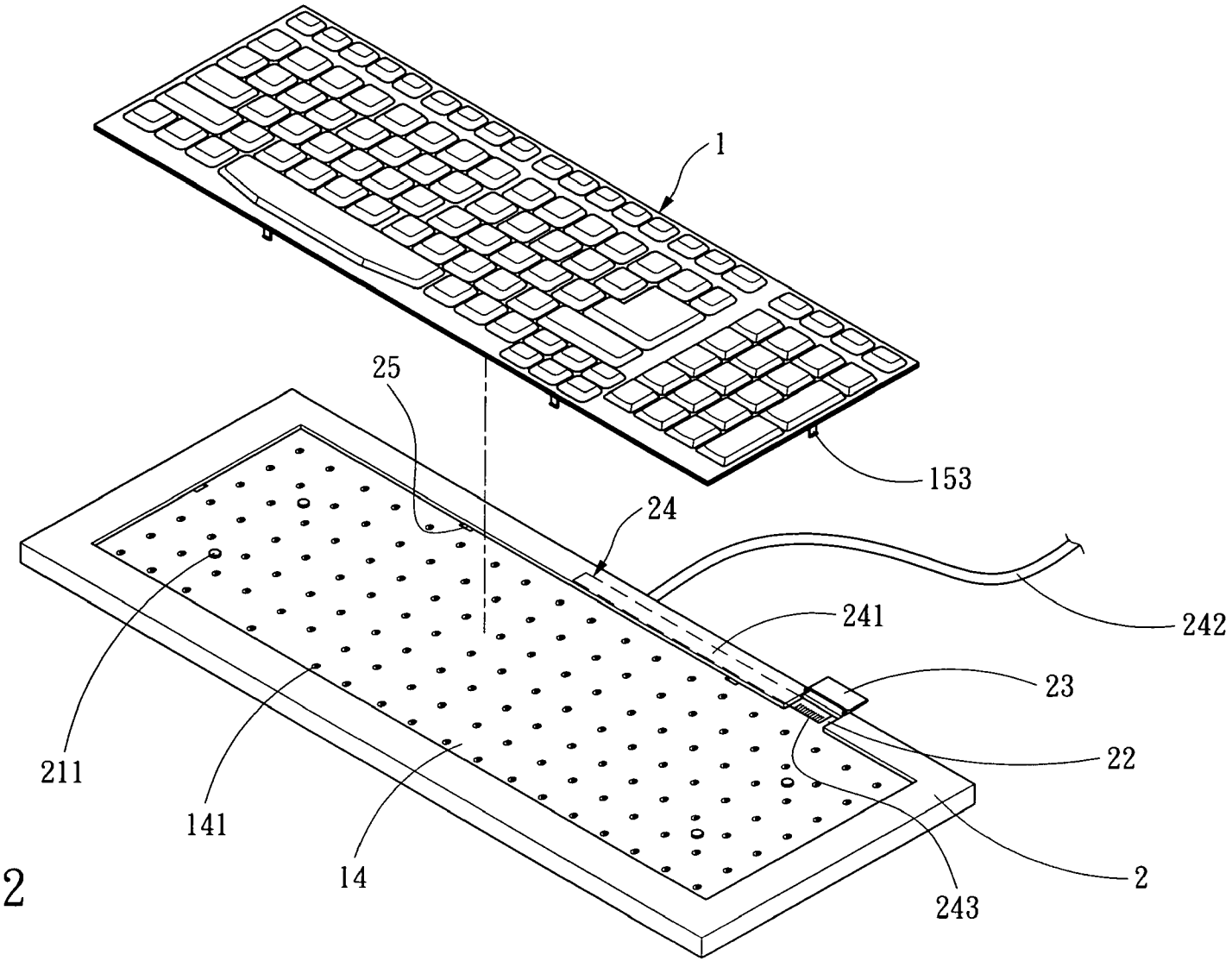
FIG. 2 is a schematic view of the invention in an assembly condition.
Figure 3A:
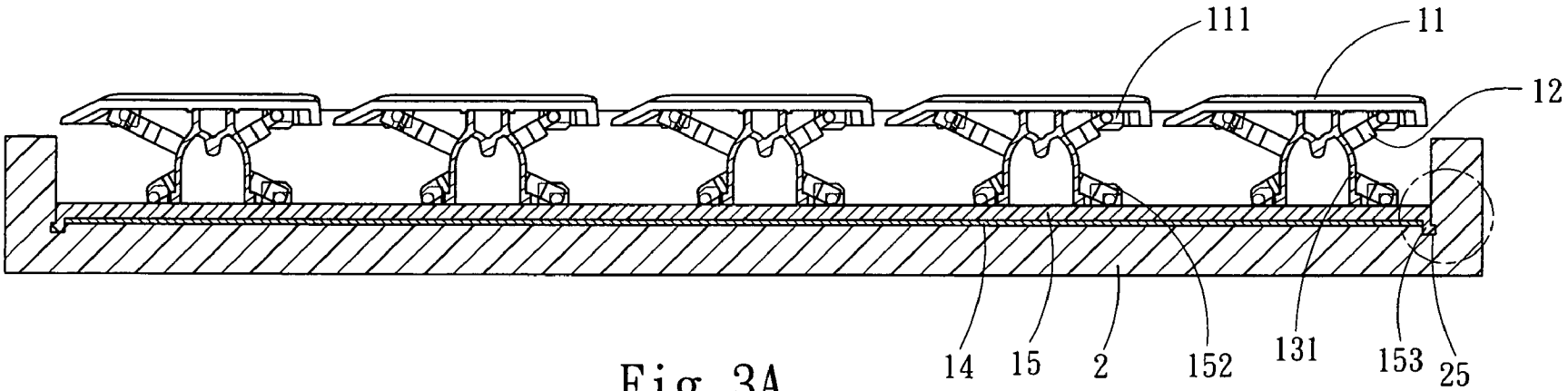
FIG. 3A is a sectional view of the invention.
Figure 3B:
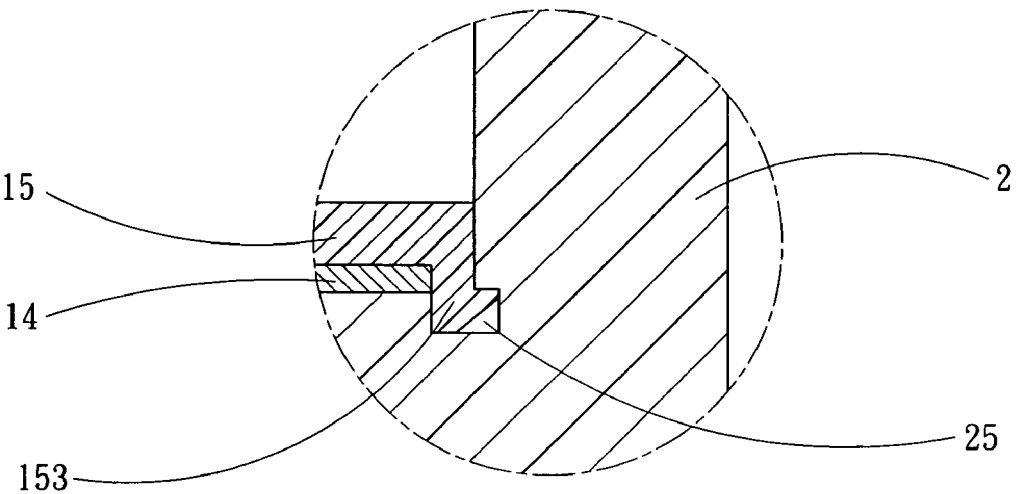
FIG. 3B is a fragmentary enlarged view according to FIG. 3A.
Figure 4:
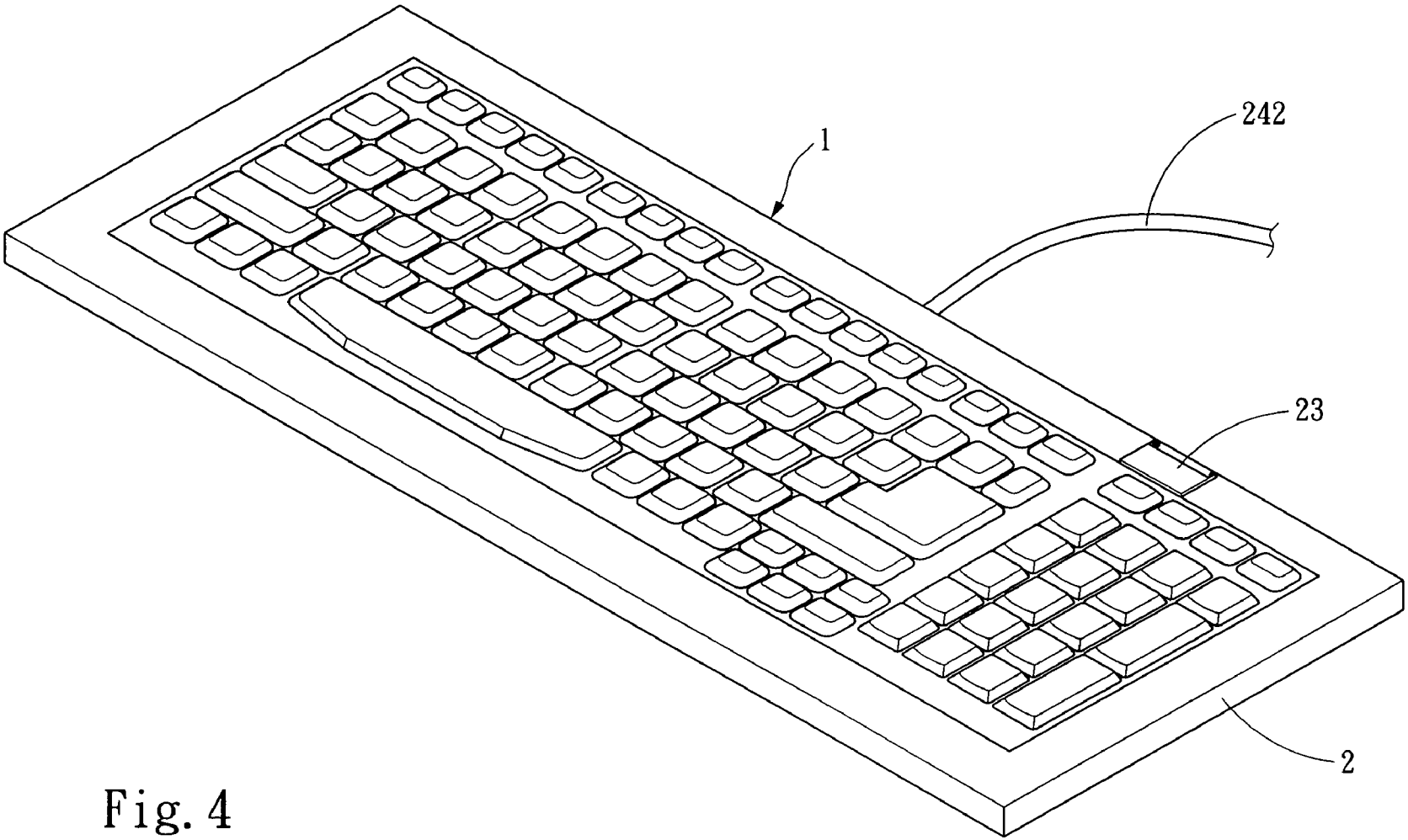
FIG. 4 is a perspective view of the invention.

Please refer to FIG. 1, the keyboard according to the invention includes a key module 1 and a base 2. The key module 1 includes a plurality of keycaps 11, a plurality of bridge mechanisms 12, a plurality of elastic click member 131, a holding board 15 and a circuit board 14. Each of the key caps 11 has a plurality of coupling portions 111 (also referring to FIG. 3A). The holding board 15 has a plurality of openings 151 and at least one second anchor portion 153. The holding board 15 also has a plurality of fastening portions 152. The circuit board 14 has a plurality of electric contacts 141 and at least one anchor hole 143. For assembly of the key module 1, place the circuit board 14 beneath the holding board 15 with the openings 151 mating the electric contacts 141; place the elastic click members 131 above the electric contacts 141 so that when the key caps 11 are depressed the elastic click members 131 are compressed to connect the electric contacts 141 to generate signals. The bridge mechanism 12 is coupled with the fastening portion 152 of the holding board 15 and the coupling portion 111 of the key cap 11 to anchor the elastic click member 131 beneath the key cap 11 to form the key module 1. The base 2 has at least one loading surface 21 which has at least one first anchor portion 25 mating the second anchor portion 153 on the key module 1 to form a confining relationship. The loading surface 21 further has at least one strut 211 corresponding to the anchor hole 143 of the circuit board 14. By coupling the second anchor portion 153 with the first anchor portion 25 the key module 1 can be fastened to the base 2 to form the keyboard.

Referring to FIGS. 2, 3A, 3B and 4, the circuit board 14 is anchored on the loading surface 21 by coupling the anchor hole 143 with the strut 211. The first anchor portions 25 are formed at inner edges of the loading surface 21. The holding board 15 is coupled with the keycaps 11, bridge mechanisms 12 and elastic click members 131. The second anchor portions 153 at the edges of the holding board 15. The first anchor portions 25 and the first anchor portions 153 can be coupled to anchor the key module 1 onto the loading surface 21. The base 2 also has a signal transmission module 24 which includes a transmission circuit board 241 containing a plurality of signal contacts 243 and a signal line 242. The base 2 further has a coupling trough 22 to allow the key module 1 to form electric contact with the signal contacts 243 to transmit electronic signals of the keyboard through the signal transmission module 24 to a computer. The coupling trough 22 further has a pivotal hole at one side to be pivotally coupled with a lid 23 to cover and protect the signal contacts 243 and circuit board 14 to form a complete keyboard. By means of the construction set forth above the key module 1 and the base 2 can be assembled easily and rapidly with fewer elements to reduce production cost. Furthermore, with the base 2 replacing the conventional technique of coupling the upper lid and lower lid, the keyboard thickness can be further reduced and become slimmer.

Figure 5:
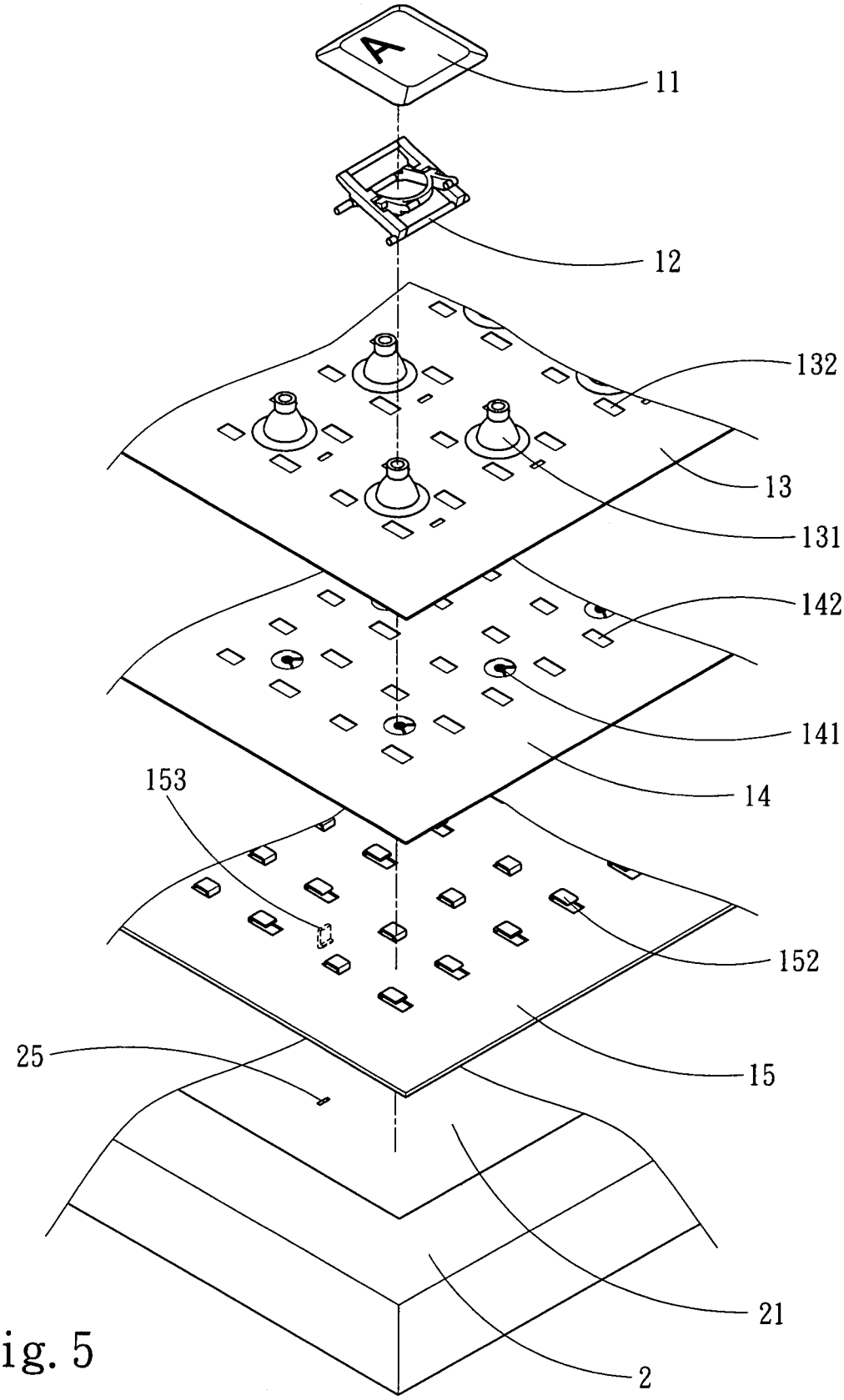
FIG. 5 is an exploded view of another embodiment of the invention.

Referring to FIG. 5, the key module 1 of the invention may also include a holding board 15, a circuit board 14, an elastic blade 13 consisting of a plurality of elastic click members 131, a plurality of bridge mechanisms 12 and a plurality of keycaps 11. The holding board 15 has a plurality of fastening portions 152 formed thereon. The elastic blade 13 and the circuit board 14 have respectively a plurality of apertures 132 and 142 to be run through by the fastening portions 152 for positioning. The elastic blade 13 covers the circuit board 14 to allow the elastic clock members 131 located above the electric contacts 141 formed on the circuit board 14. The bridge mechanisms 12 are located above the elastic blade 13. The fastening portions 152 run through the apertures 132 to be coupled with the bridge mechanisms 12. The bridge mechanisms 12 have an upper side coupling with the coupling portions 111 of the key caps 11 (referring to FIG. 3A) and support the keycaps 11 above the elastic click members 131 to form the key module 1. The second anchor portion 153 may also be located beneath the holding board 15. The loading surface 21 of the base 2 has a corresponding first anchor portion 25. Thus the key module 1 can be anchored on the base 2 to form a keyboard. The base 2 covers the edges and a lower side of the key module 1 to expose only the keys. Hence the thickness of the upper lid and lower lid can be saved to make the keyboard slimmer.

The present invention has the base 2 to replace the conventional upper lid and lower lid, and can reduce the thickness of the entire keyboard. The key module 1 and base 2 can be coupled by a slight compression. Assembly process is simpler and assembly time is shorter. Production speed is faster and production cost is lower. In addition, in the signal transmission module 24 the signal line 242 can be replaced by a wireless transmission module (not shown in the drawings) to form a wireless keyboard.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A keyboard comprising:

a base having at least a loading surface; and a key module;

wherein the key module is mounted onto the loading surface and includes at least a circuit board which has an elastic click member located thereon, a holding board which has a plurality of fastening portions, a plurality of key caps which have a coupling portion and a plurality of bridge mechanisms coupling with the fastening portions and the coupling portions;

wherein the base and the key module have respectively a first anchor portion and a second anchor portion that form a confining relationship such that the key module is engageable with the base to form the keyboard; and wherein the base has a signal transmission module which is electrically connected to the key module, and a coupling trough to allow the circuit board and the signal transmission module to form an electric connection therein.

2. The keyboard of claim 1, wherein the second anchor portion is formed at edges of the holding board and the first anchor portion is formed at an inner side of the loading surface, and the first and second anchor portions are engageable with each other to allow the key module to be anchored on the loading surface.

3. The keyboard of claim 2, wherein the circuit board is anchored on the loading surface, the bridge mechanisms are coupled with the fastening portions and the coupling portions to support the key caps on the holding board, the elastic click member is located beneath the key caps, and the holding board has an opening beneath the elastic click member such that the elastic click member is connected to the circuit board when the key caps are depressed.

4. The keyboard of claim 3, wherein the circuit board has an electric contact beneath the elastic click member to generate a signal when the elastic click member is connected to the electric contact.

5. The keyboard of claim 3, wherein the loading surface has a plurality of struts, and the circuit board has a plurality of anchor holes corresponding to and run through by the struts to anchor the circuit board on the loading surface.

6. The keyboard of claim 1, wherein the circuit board is mounted onto the holding board, the elastic click member is formed on an elastic blade located above the circuit board, the elastic blade and the circuit board respectively have a plurality of apertures to be run through by the fastening portions of the holding board, and the bridge mechanisms are located on the elastic blade and coupled with the fastening portions and the coupling portions to be anchored.

7. The keyboard of claim 6, wherein the second anchor portion is located at the edges of the holding board, and the first anchor portion is located at an inner side of the loading surface to allow the key module to be anchored on the loading surface.

8. The keyboard of claim 6, wherein the second anchor portion is located beneath the holding board and the first anchor portion is located on the loading surface corresponding to the second anchor portion.

9. The keyboard of claim 6, wherein the circuit board has an electric contact beneath the elastic click member to generate a signal when in contact with the elastic click member.

10. The keyboard of claim 1, wherein the signal transmission module has a transmission circuit board which has a plurality of signal contacts and a signal line.

11. The keyboard of claim 1, wherein the signal transmission module has a transmission circuit board which has a plurality of signal contacts and a wireless transmission means.

12. The keyboard of claim 1, wherein the coupling trough has a pivotal hole at one side to be pivotally coupled with a lid to cover the coupling trough.

* * * * *